US010562088B2

(12) United States Patent
LaRochelle et al.

(10) Patent No.: US 10,562,088 B2
(45) Date of Patent: Feb. 18, 2020

(54) PIPE GROOVING DEVICE

(71) Applicants: Tyson LaRochelle, Monmouth, ME (US); Gerard Bosse, Litchfield, ME (US)

(72) Inventors: Tyson LaRochelle, Monmouth, ME (US); Gerard Bosse, Litchfield, ME (US)

( * ) Notice: Subject to any disclaimer, the term of this patent is extended or adjusted under 35 U.S.C. 154(b) by 505 days.

(21) Appl. No.: 15/189,020

(22) Filed: Jun. 22, 2016

(65) Prior Publication Data

US 2016/0375478 A1 Dec. 29, 2016

Related U.S. Application Data

(60) Provisional application No. 62/183,778, filed on Jun. 24, 2015.

(51) Int. Cl.
*B21D 17/04* (2006.01)

(52) U.S. Cl.
CPC ..... *B21D 17/04* (2013.01)

(58) Field of Classification Search
CPC ..... B21D 17/04
See application file for complete search history.

(56) References Cited

U.S. PATENT DOCUMENTS 5,002,318 A * 3/1991 Witter ..... F16L 27/12 169/37
5,079,940 A * 1/1992 Pulver ..... B21D 17/04 72/105
5,636,541 A * 6/1997 Castricum ..... B21C 37/127 72/132
6,192,726 B1 * 2/2001 Castricum ..... B21C 37/121 72/49
6,244,088 B1 * 6/2001 Compton ..... B21D 17/04 470/67
6,502,446 B2 * 1/2003 Potthoff ..... B21B 13/103 72/224
6,993,949 B2 * 2/2006 Dole ..... B21D 17/04 72/105
2002/0129635 A1 * 9/2002 Dole ..... B21D 17/04 72/70
2003/0061851 A1 * 4/2003 Hamm ..... B21D 17/04 72/105
2005/0178179 A1 * 8/2005 Dole ..... B21D 17/04 72/106
2009/0223268 A1 * 9/2009 Hasenfus ..... F16C 3/03 72/105

OTHER PUBLICATIONS

RIDGID Power Threading Machines, Wayback Machine extract of Mar. 23, 2015, 2 Pages. (Year: 2015).*

* cited by examiner

*Primary Examiner* — Gregory D Swiatocha
(74) *Attorney, Agent, or Firm* — Jeffrey Joyce, Esq.

(57) ABSTRACT

A pipe grooving tool that works with commercially-available power drives. The tool attaches to the power drive using the existing tool assembly on the power drive, and allows a single operator to cut, ream and groove multiple pipe segments, without having to replace tools or otherwise alter the power drive and its tool assembly between grooving different pipe segments.

5 Claims, 10 Drawing Sheets

PIPE GROOVING DEVICE

BACKGROUND INFORMATION

Field of the Invention

The invention relates to grooving tools, more specifically, a tool that can be used with an existing power drive for creating a groove on a pipe.

Discussion of Prior Art

Tools for cutting, threading and grooving pipes have been known for considerable time. Common power tools, such as the RIDGID 300 Power Drive, provide an assembly that combines tools for cutting, reaming and threading a pipe. Such tools are typically used by inserting a pipe through a center opening in the power drive and securing it in place by a vice. Actuating the drive causes the pipe to spin. A user then applies the cutting device to cut the pipe to the desired length, and then uses the reamer to remove the inside burrs. A threading die-head may then be used to thread the end of the pipe.

If a user wishes to groove the pipe, he must remove the entire tool assembly and attach an external grooving tool that is used to create a groove on the pipe. The typical grooving tool is attached to the power drive which causes a grooving axle to rotate. A pipe is then placed over the end of the axle and a groove is created in the pipe. This often results in a situation in which an additional operator has to hold the opposite end of a long piece of pipe as it is being grooved. Should the operator then wish to cut the next section of pipe, the grooving tool has to be removed and the cut/ream/thread assembly reattached, creating a cumbersome process when an operator needs to cut and groove many pieces of pipe.

What is needed is a grooving tool that works with the original assembly. What is further needed is such a grooving tool that does not require the exchange of tools to cut and then groove a piece of pipe. What is yet further needed is such a grooving tool that is operable by a single operator.

BRIEF SUMMARY OF THE INVENTION

The invention is a pipe grooving device that works with an existing power drive. Conventional power drives have tool assemblies that include pipe cutters, reamers, and threaders. The device according to the invention works within this type of assembly, making use of the power drive to perform its intended function.

The grooving device has an attachment assembly that secures the device to the power drive's tool assembly, possibly replacing an existing tool, and a freewheeling groove shaft that supports the position of a pipe. Once the device is secured to the power drive's tool assembly and placed in the proper position, a pipe is placed through a center opening in the power drive, over the groove shaft and secured to the power drive by a vice. The power drive and vice are capable of supporting the weight of long pieces of pipe. Actuating the power drive causes the pipe to spin.

The grooving device also has a wheel housing that contains a groove wheel and an activation rod that is operatable by a user. Operating the activation rod applies pressure to the wheel housing, causing the pipe to be pinched between the groove wheel and groove shaft and creating a groove on the pipe.

The grooved pipe is then cut or simply removed from the power drive, and the operator may proceed with cutting and grooving the next segment of pipe without having to alter the power drive or its tool assembly.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
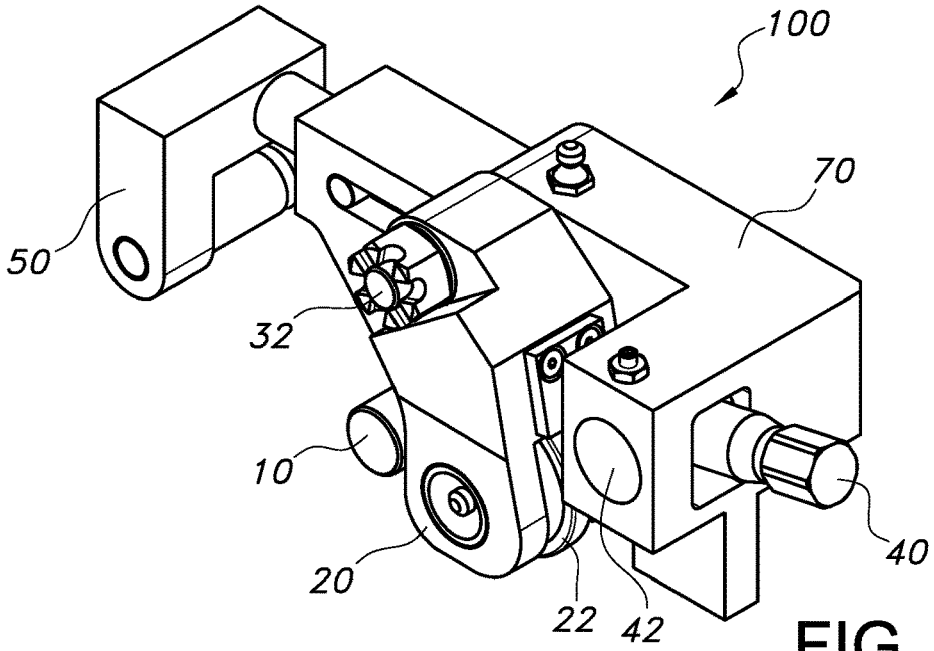
FIG. 1 is a perspective view of the device according to the invention.
Figure 2:
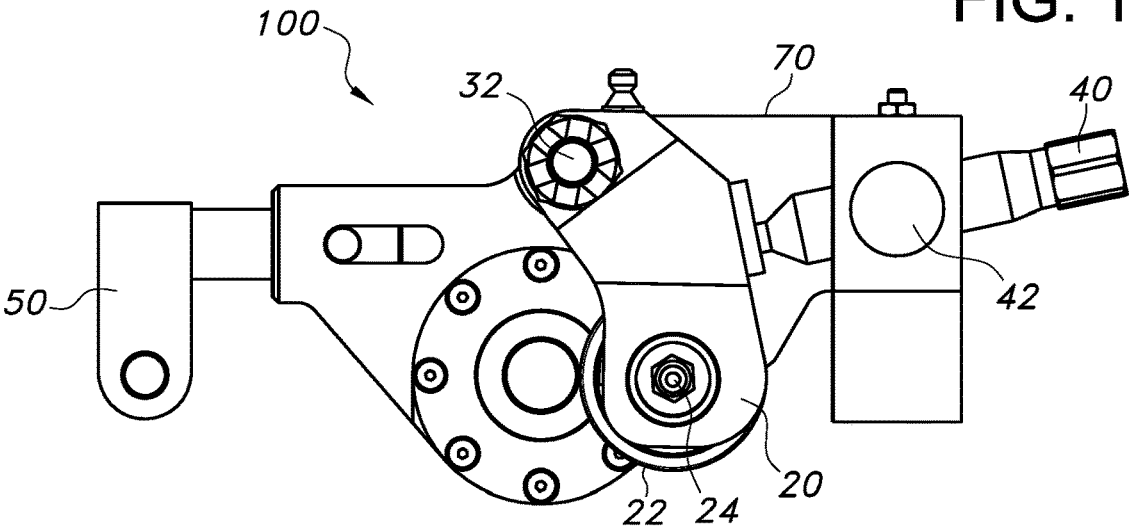
FIG. 2 is a side view of the device.
Figure 3:
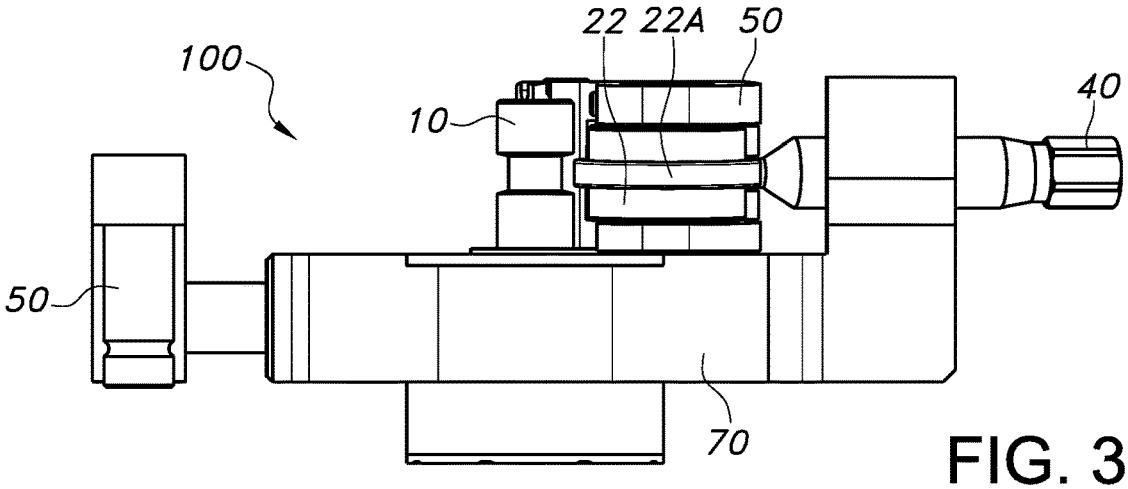
FIG. 3 is a bottom view of the device.
Figure 4:
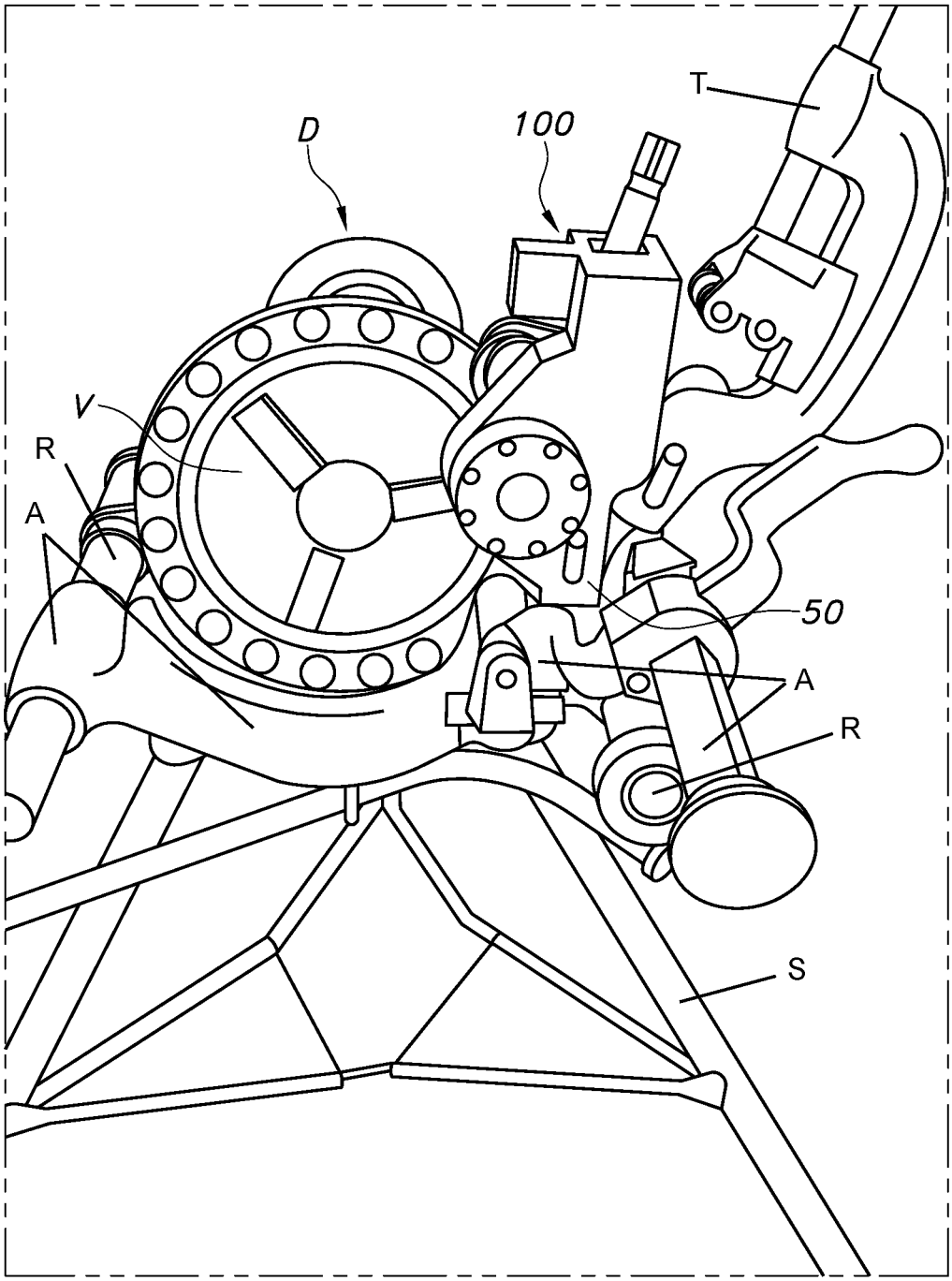
FIG. 4 is a side view of the device attached to a power drive.
Figure 5:
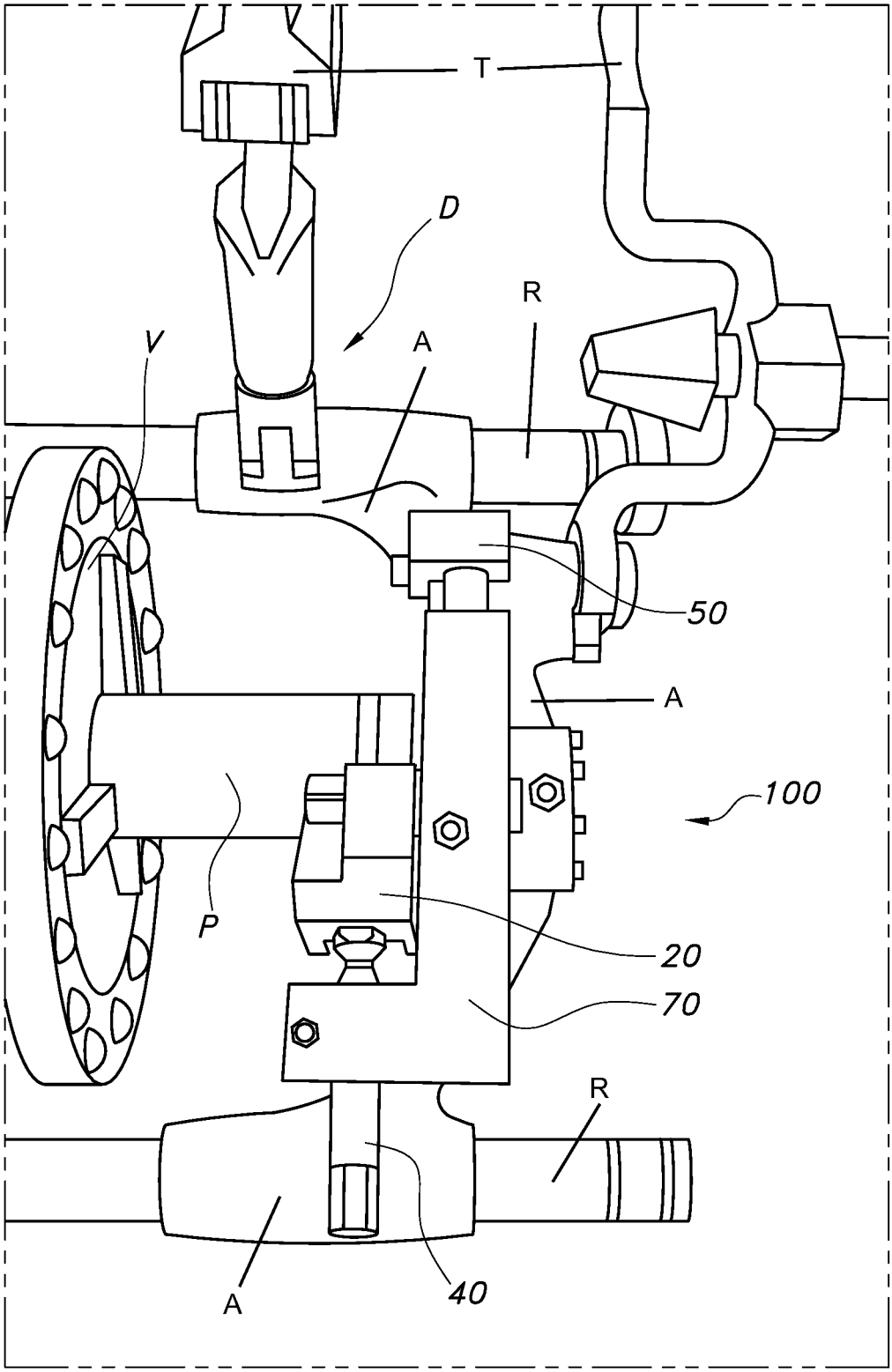
FIG. 5 is a top view of the device attached to a power drive, showing a pipe in the power drive.
Figure 6:
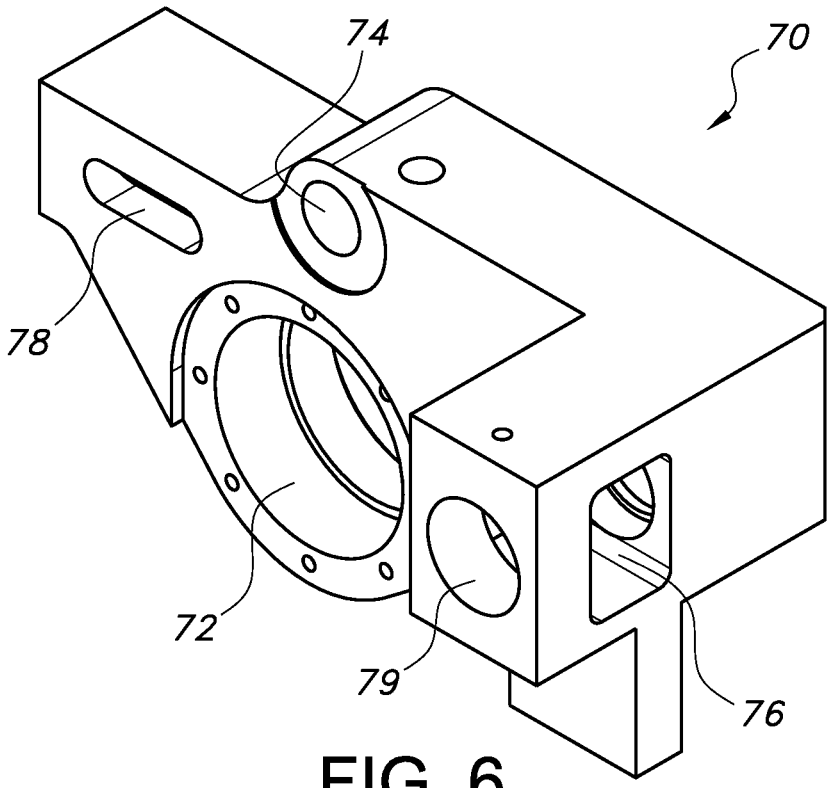
FIG. 6 is a perspective view of the device housing.
Figure 7:
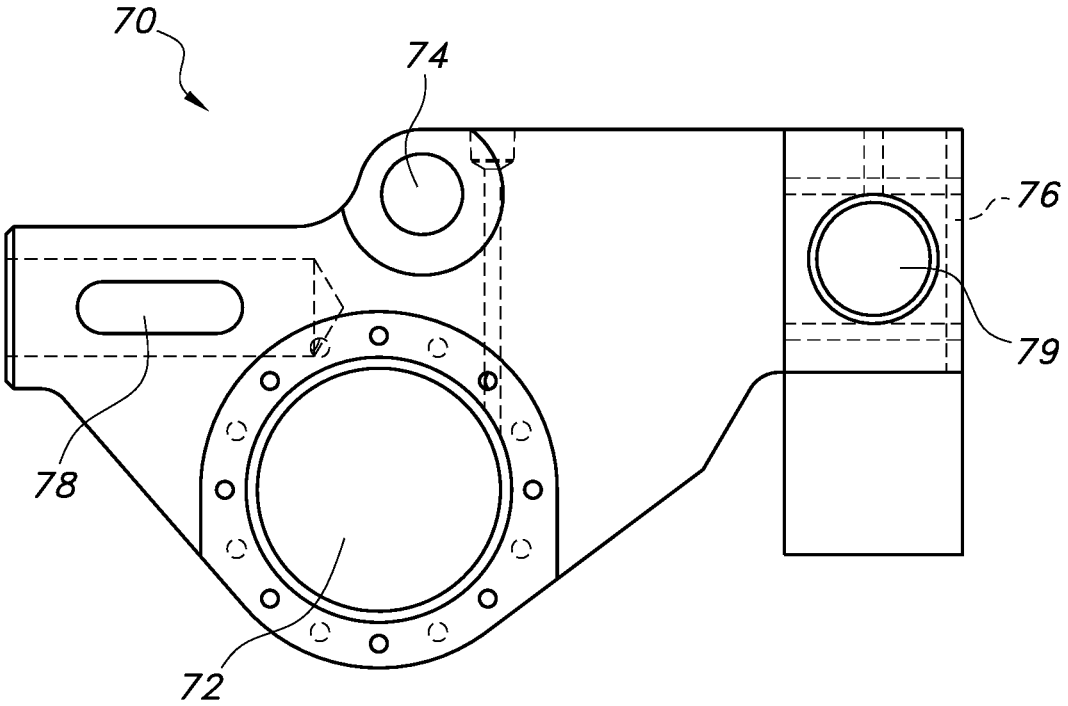
FIG. 7 is a side view of the device housing.
Figure 8:
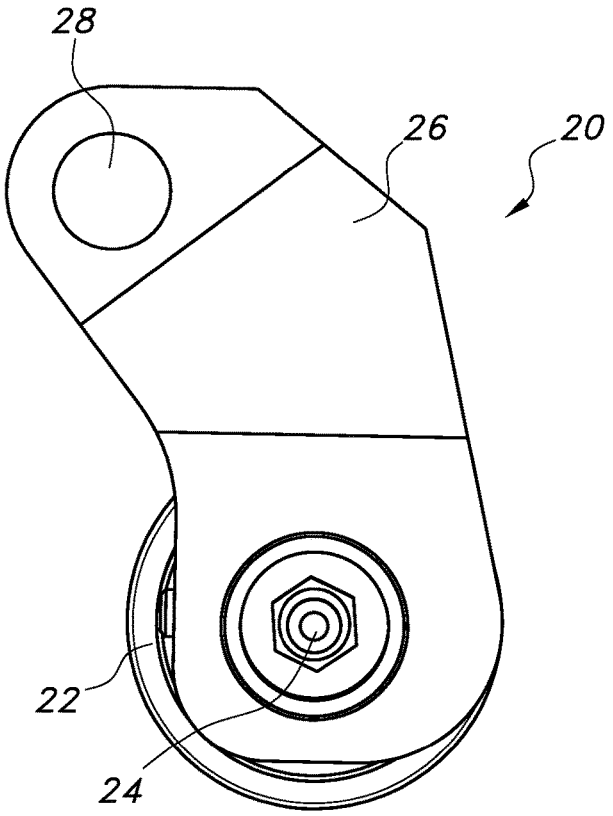
FIG. 8 is a side view of the wheel housing assembly.
Figure 9:
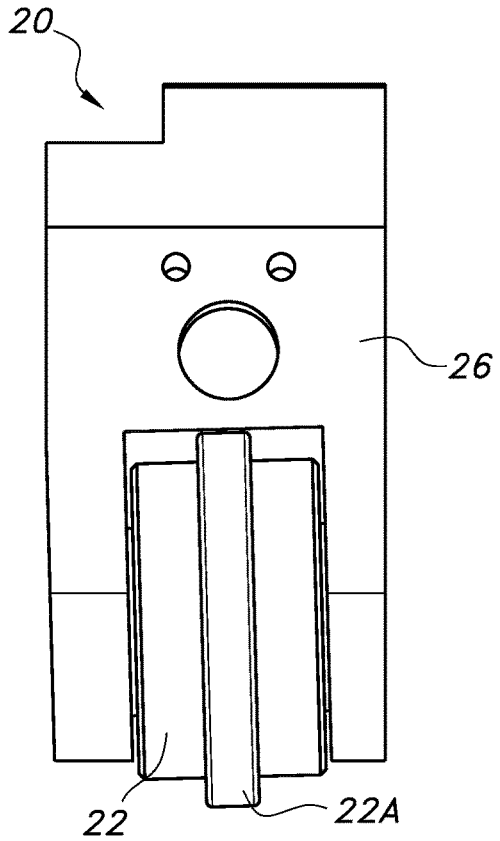
FIG. 9 is a front view of the wheel housing assembly.
Figure 10:
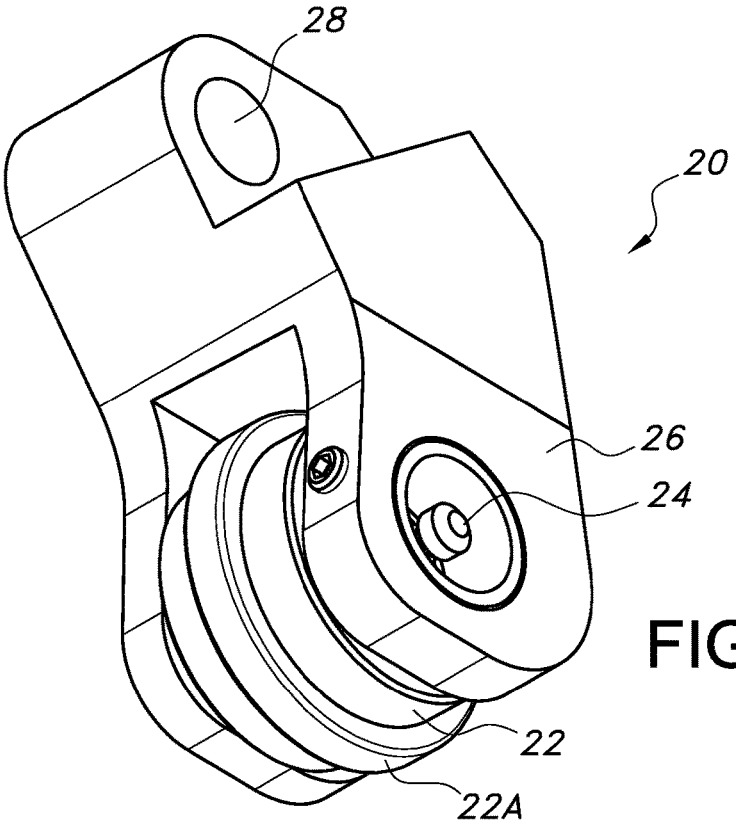
FIG. 10 is a perspective view of the wheel housing assembly.
Figure 11:
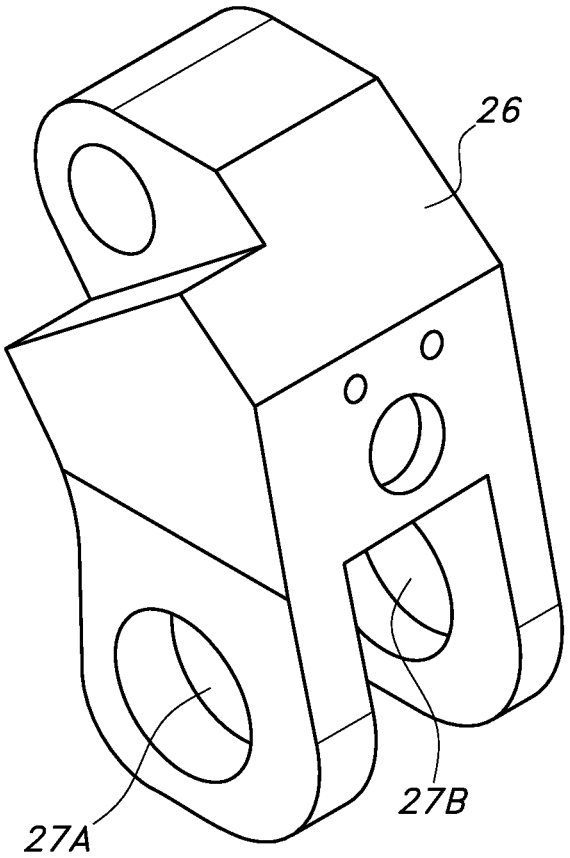
FIG. 11 is a perspective view of the wheel housing.
Figure 12:
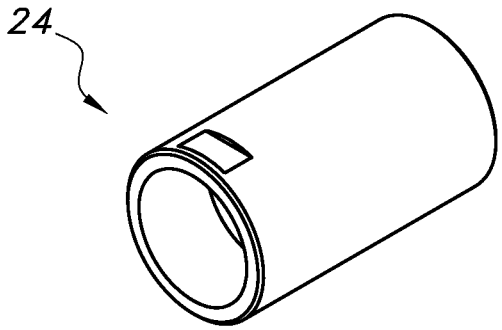
FIG. 12 is a perspective view of the wheel axle.
Figure 13:
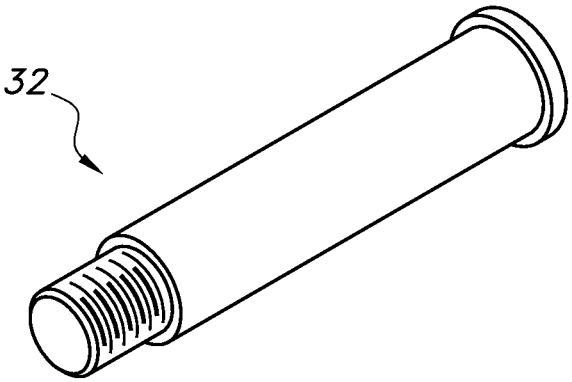
FIG. 13 is a perspective view of the pivot pin.
Figure 14:
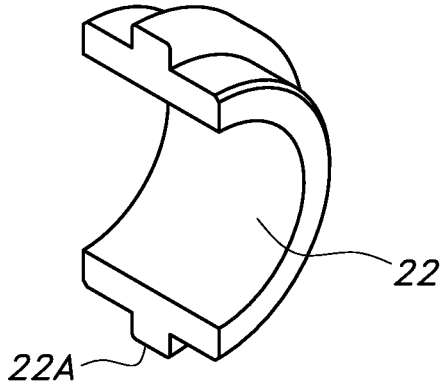
FIG. 14 is a perspective cross-sectional view of the wheel.

FIGS. 1, 2, and 3 illustrate a pipe grooving device 100 according to the invention that includes a groove shaft 10, a wheel housing assembly 20, an activation rod 40 and an attachment assembly 50, each contained in a device housing 70. The device 100 pivotably attaches to a power drive D by attachment assembly 50. FIG. 4 illustrates the grooving device 100 in a first position and FIG. 5 illustrates the device 100 in a second position where it has been pivoted to an operational position that is approximately in line with an opening in the power drive D.

The power drive D is typically placed on a stand S or bench, and a pair of carriage rails R extend outward and away from the drive D. A tool assembly A is removably attached to the carriage rails R, and typically holds a number of conventional tools T such as pipe cutters, reamers, and threaders. The attachment assembly 50 secures the pipe grooving device 100 in the tool assembly A, allowing a user to, for example, groove and cut multiple pieces of pipe without having to alter the power drive D or its tool assembly A.

To create a groove in a pipe P, the pipe P is inserted through the power drive D and placed over the groove shaft 10 and secured in the power drive D by a vice V. Activating the power drive D causes the pipe P to rotate about the groove shaft 10. A user operates the activation rod 40 by, for example, attaching a socket wrench (not shown) to the activation rod 40 and rotating the wrench. As the activation rod 40 rotates it applies pressure to the wheel housing assembly 20. The wheel housing assembly 20 has a groove wheel 22 that presses against the pipe P as the power drive rotates the pipe P and the user operates the activation rod 40, pushing the pipe P into a groove recess 16 on the groove shaft 10 creating the groove in the pipe P.

Figure 18:
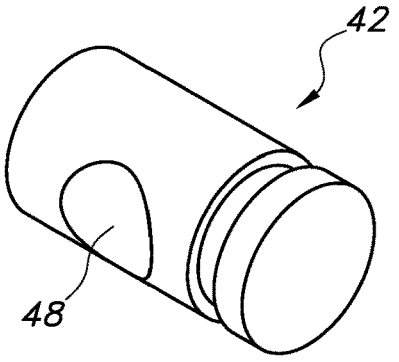
FIG. 18 is a perspective view of the activation rod securing unit.
Figure 19:
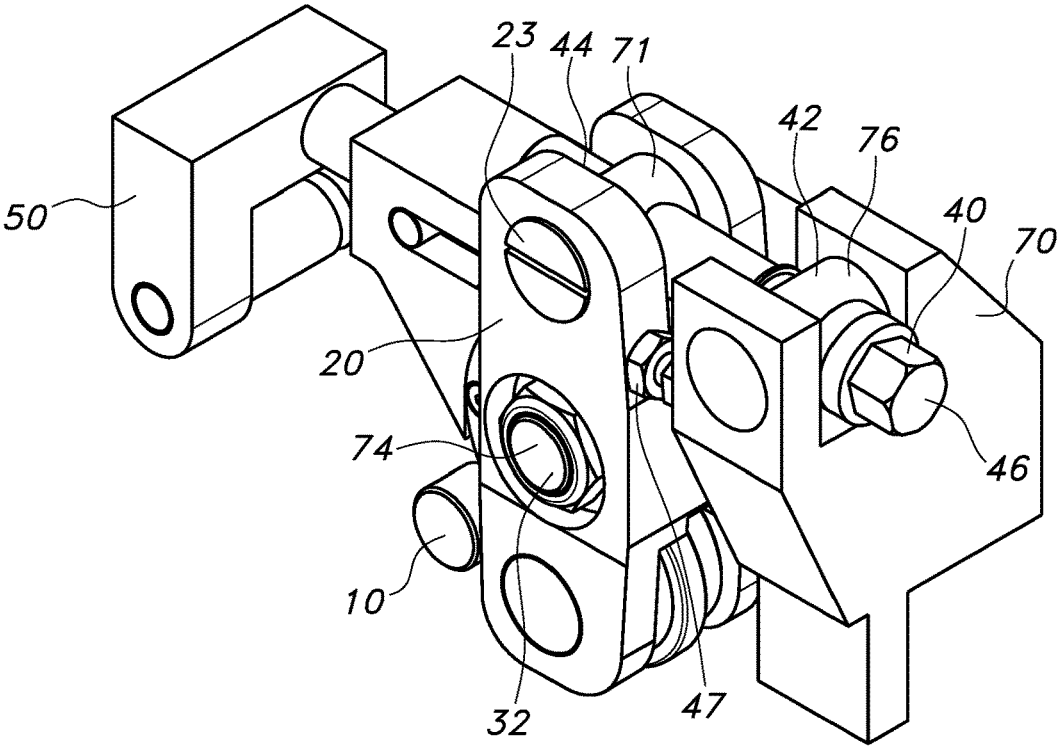
FIG. 19 is a perspective view of the device showing a second embodiment of the wheel housing and device housing.
Figure 20:
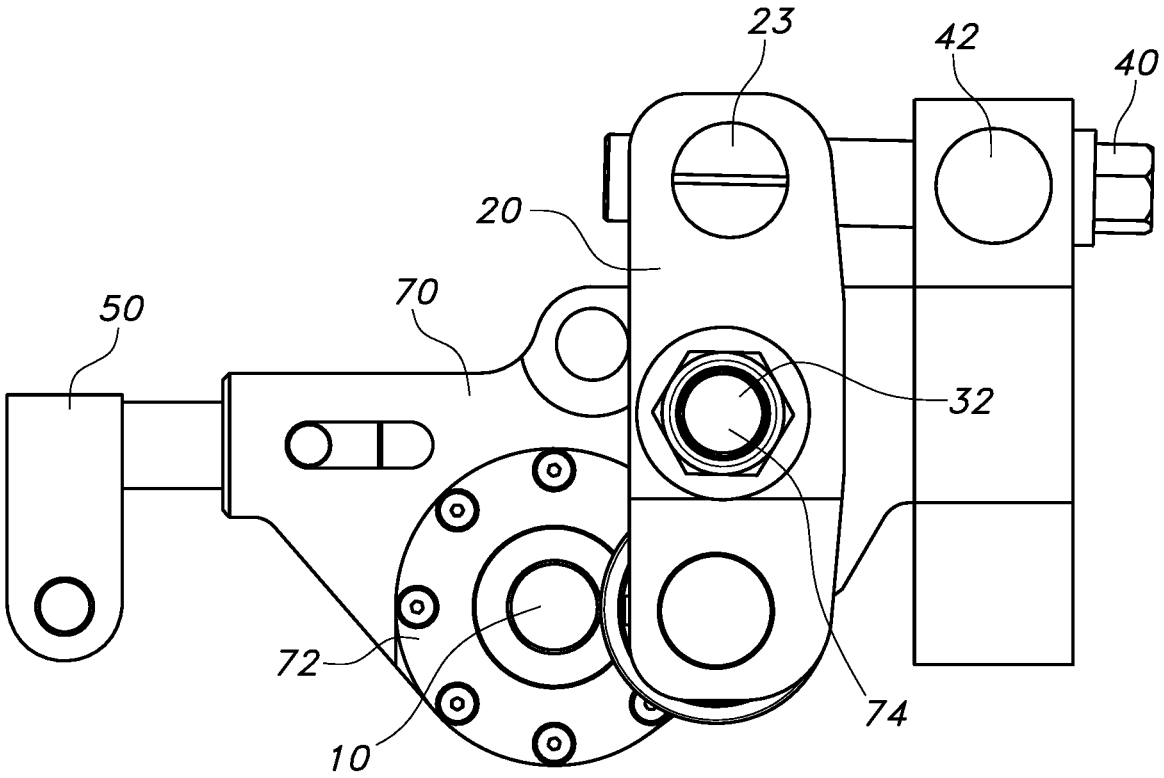
FIG. 20 is a side view of the device showing a second embodiment of the wheel housing and device housing.
Figure 21:
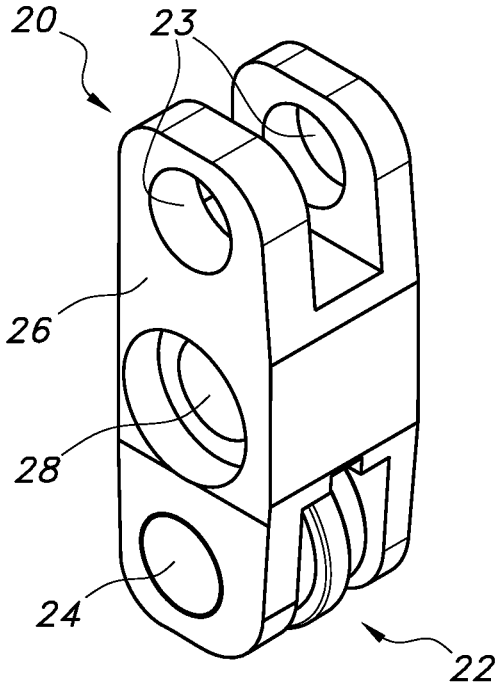
FIG. 21 is a perspective view of a second embodiment of the wheel housing.
Figure 22:
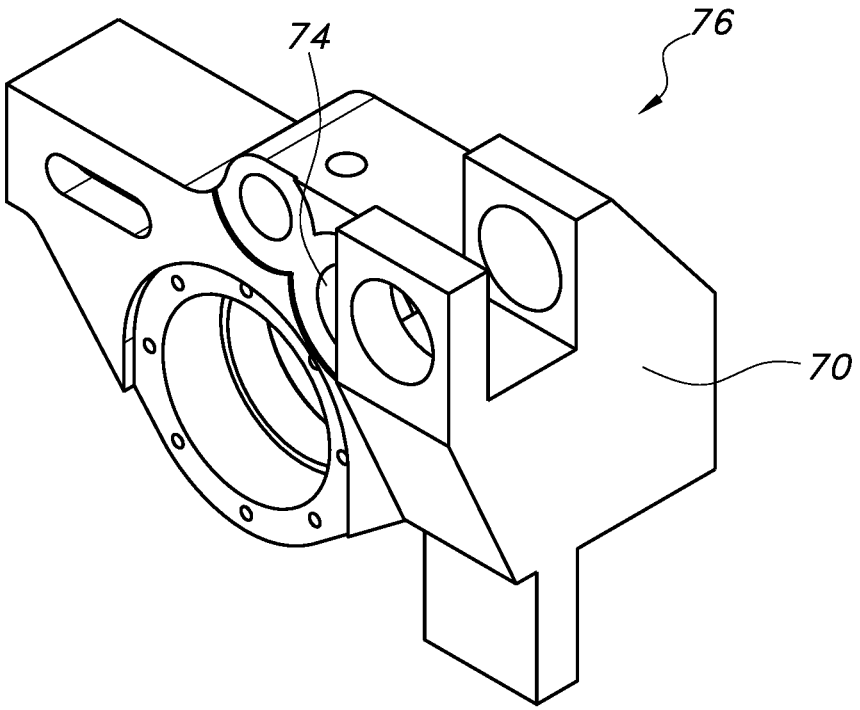
FIG. 22 is a perspective view of a second embodiment of the device housing.

FIGS. 6-14 illustrate first embodiments of the device housing 70 and wheel housing 20. The device housing 70 is a solid piece of material that has been formed to support the wheel housing assembly 20, activation rod 40, groove shaft 10, and attachment assembly 50. The groove shaft 10 is mounted in a bearing assembly 72 that includes one or more bearings and is free to rotate. The wheel housing 20 is pivotably coupled to the device housing 70 by a pivot pin 32 that is shown in FIGS. 1 and 2 and that is inserted through a through-bore pivot point 74 and through a housing attachment bore 28. A securing unit 42, shown in FIGS. 1, 2 and 18, is inserted through a rod insertion bore 76. The activation rod 40 is adjustably inserted through the securing unit 42 and is in contact with the wheel housing 20 at a location beneath the pivot point 74. The attachment assembly 50 is fixedly coupled to the device housing 70 at an attachment slot 78.

FIGS. 11-14 illustrate details of the wheel housing assembly 20, which includes the groove wheel 22, an axle 24, a housing 26 and a housing attachment opening 28. The axle 24 is secured in the housing 26 through housing openings 27A, 27B. The wheel 22 is coupled to the axle 24. A center portion 22A of the wheel 22 protrudes outward from the wheel 20, such that, when the wheel 20 is pressed against the pipe P, the center portion 22A is forced into the pipe P, thereby forming a groove.

Figure 15:
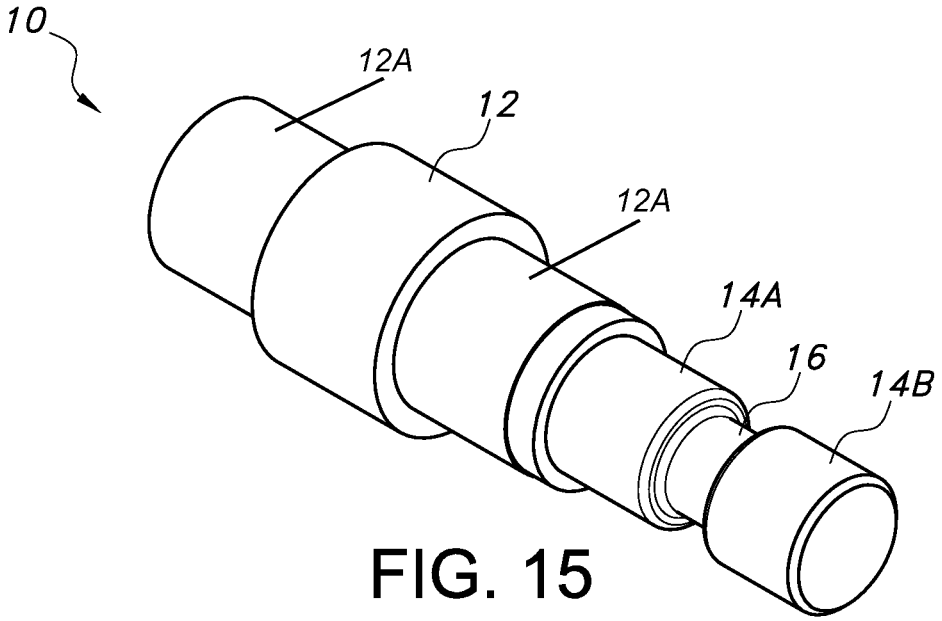
FIG. 15 is a perspective view of the groove shaft.
Figure 16:
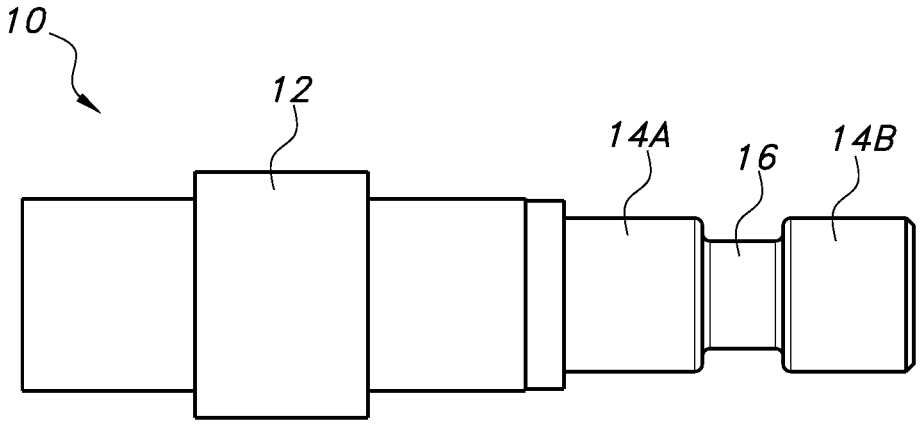
FIG. 16 is a side view of the groove shaft.

FIGS. 15 and 16 illustrate the groove shaft 10. The groove shaft 10 has a stepped diameter, including a shaft connection diameters 12 and 12A, and pipe fitting diameters 14A, 14B. The groove recess 16 is formed between pipe fitting diameters 14A, 14B. The shaft connection diameters 12 and 12A are mounted in the bearing assembly 72 in the device housing 70. The pipe P fits over the pipe fitting diameters 14A, 14B, which are sized to allow the removal of the pipe once the groove has been created. As the user operates the device the power drive rotates the pipe P, the center portion of the wheel 22A presses against the pipe P, pushing the pipe P in the direction of the groove recess 16 and forming the groove in the pipe P.

Figure 17:
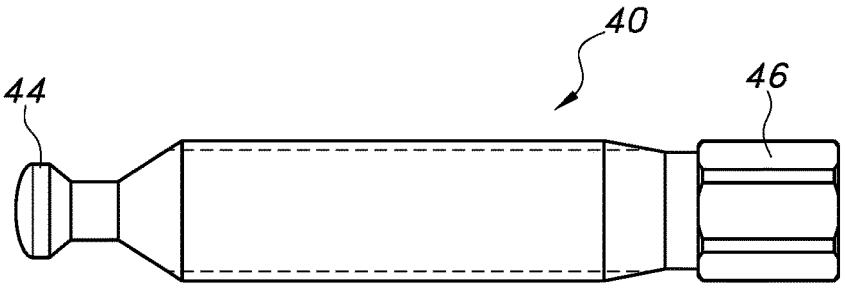
FIG. 17 is a side view of the activation rod.

FIG. 17 illustrates the activation rod 40, which is inserted through and secured by the securing unit 42, shown in FIG. 18. A first end 44 of the activation rod 40 is shaped to fit against and apply pressure to the wheel housing 20, while a second end 46 is shaped to be manipulated by an operator. For example, the second end 46 may be shaped to fit a socket wrench that can then be tightened or loosened by an operator to apply more or less pressure to the wheel housing unit 20 as desired. The securing unit 42 is fixedly attached to the device housing 70 at a rod connection point 79, shown in FIGS. 6 and 7. In one embodiment the activation rod 40 is threaded and the securing unit 42 has a threaded bore 48 through which the activation rod 40 is inserted and adjusted.

FIGS. 19-23 illustrate second embodiments of the device housing 70 and the wheel housing 20. Again the device housing 70 is a solid piece of material that has been formed to support the wheel housing assembly 20, activation rod 40, groove shaft 10, and attachment assembly 50. The groove shaft 10 and bearing assembly 72 are the same as shown in the first embodiment. The wheel housing 20 is pivotably attached to a pivot point 74 by a pivot pin 32. A securing unit 42 is inserted through an activation rod insertion slot 76. The activation rod 40 is adjustably inserted through the securing unit 42 and fixedly connected to the top of the wheel housing 20 by a connection rod 71 that is affixed to the upper housing openings 23. Operating the activation rod pushes or pulls the top of the wheel housing 20, causing the groove wheel 22 to apply or release pressure against the pipe P depending on the direction of operation. An adjustment stop 47 may be provided to limit how far the user is able to turn the activation rod 40.

The wheel housing assembly 20 includes a groove wheel 22, an axle 24, a housing 26 and a housing attachment opening 28 and is attached to the device housing 70 as shown in the first embodiment. In this second embodiment, the first end of the activation rod 44 is secured to the wheel housing 20 at a point above the pivot point 74. Operating the second end 46, by, for example, turning the wrench, causes the top of the housing to be pulled away from the groove shaft 10 or pushed towards the groove shaft 10, depending on the direction of the rotation, causing the wheel 22 to press against or pull away from the pipe P.

Figure 23:
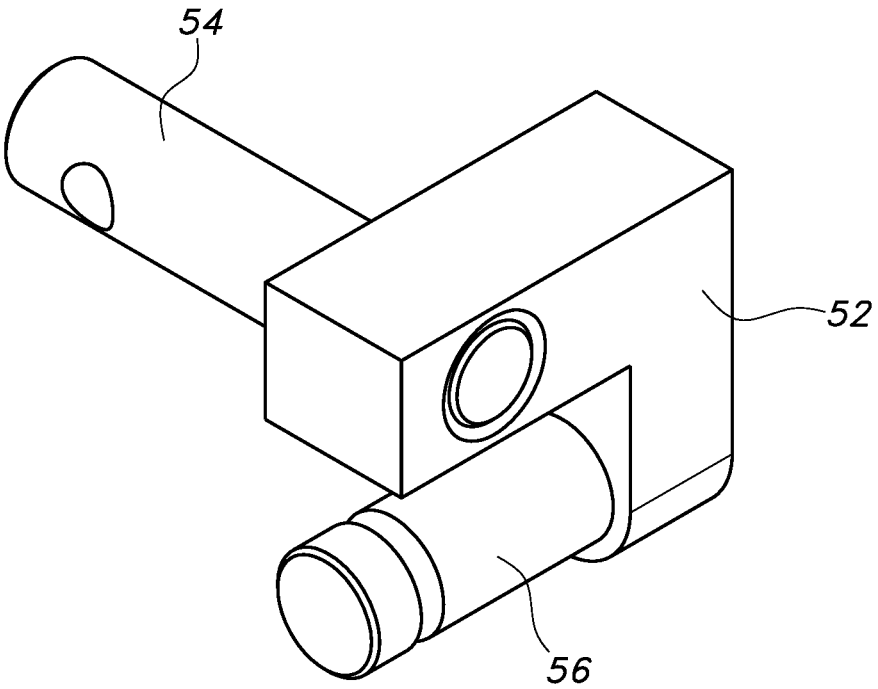
FIG. 23 is a perspective view of the attachment assembly.

FIG. 23 illustrates the attachment assembly 50, including a housing 52, a device attachment shaft 54 and a power drive attachment shaft 56. The housing 52 secures the two shafts 54 and 56. The device attachment shaft 54 secures the attachment assembly 50 to the device housing 70 at a connection slot 78, shown in FIGS. 6 and 7. The connection slot 78 is wider than the attachment shaft 54 which allows the device 100 to be moved in or out relative to the pipe in order to allow the pipe grooving device 100 to groove pipes of varying size. The power drive attachment shaft 56 pivotably couples the device 100 to the power drive D.

It is understood that the embodiments described herein are merely illustrative of the present invention. Variations in the construction of the pipe grooving device may be contemplated by one skilled in the art without limiting the intended scope of the invention herein disclosed and as defined by the following claims.

What is claimed is:

1. A pipe grooving device for creating a groove on a pipe and that is adapted to be pivotably coupled to a power drive having carriage rails and a tool assembly, the tool assembly being removably coupled to the carriage rails, the pipe grooving device comprising:

a device housing having a groove shaft and an attachment assembly, the groove shaft freely rotatable within the device housing;

a wheel housing assembly pivotably connected to the device housing;

an activation rod adjustably connected to the device housing;

wherein the attachment assembly includes an attachment housing in which a device attachment shaft and a tool assembly attachment shaft are secured, the tool assembly attachment shaft running parallel to the groove shaft and the device attachment shaft running perpendicular to the groove shaft, such that the device housing is pivotably coupled to the tool assembly so as to be moveable between a first position where the groove shaft is approximately in line with an opening in the power drive and a second position where the device housing is not in line with the opening in the power drive such that other tools may be used with the power drive;

wherein when the groove shaft is approximately in line with the opening in the power drive the pipe is insertable through the opening in the power drive and insertable over the groove shaft such that the power drive supports the weight of the pipe and rotates the pipe about the groove shaft, the power drive holding the pipe in a fixed longitudinal position;

wherein turning the activation rod causes the wheel housing assembly to move toward or away from the groove shaft, depending on a direction of rotation of the activation rod, the wheel housing assembly creating a groove in the pipe as the wheel housing assembly presses the pipe against the groove shaft as the pipe is rotated by the power drive and the groove shaft rotates freely.

2. The device of claim 1 wherein the wheel housing assembly includes a groove wheel having a center portion that protrudes outward from the groove wheel;

wherein the groove shaft has a recess; and wherein rotating the activation rod in a manner that moves the wheel housing assembly towards the groove shaft causes the center portion of the groove wheel to move towards the recess in the groove shaft.

3. The device of claim 2 wherein the activation rod is inserted through and secured to the device housing by a rod securing unit and the activation rod has a first end that is shaped to fit against and apply pressure to the wheel housing assembly and has a second end rotatable by a user and wherein rotating the activation rod causes the first end to selectively apply or relieve pressure to the wheel housing assembly, depending on the direction of rotation.

4. The device of claim 2 wherein the activation rod is adjustably inserted through and secured to the device housing by a rod securing unit and the activation rod has a first end that is connected to the wheel housing and the activation rod has a second end rotatable by a user and wherein rotating the activation rod pulls or pushes a top portion of the wheel housing assembly causing the groove wheel to move towards or away from the groove shaft, depending on the direction of rotation.

5. The device of claim 1, wherein the attachment assembly is slidably coupled to the tool assembly so that the device housing is slidable towards and/or away from the tool assembly so as to groove pipes of varying sizes.

* * * * *